US006918557B2

(12) United States Patent
Ast et al.

(10) Patent No.: US 6,918,557 B2
(45) Date of Patent: Jul. 19, 2005

(54) STRING OF LIGHTS REEL

(76) Inventors: Larry J. Ast, 534 Embassy Loop, Woodland, WA (US) 98674; Christina A. Ast, 534 Embassy Loop, Woodland, WA (US) 98674

( * ) Notice: Subject to any disclaimer, the term of this patent is extended or adjusted under 35 U.S.C. 154(b) by 0 days.

(21) Appl. No.: 10/456,147

(22) Filed: Jun. 6, 2003

(65) Prior Publication Data

US 2004/0245362 A1 Dec. 9, 2004

(51) Int. Cl.[7] ..... B65H 75/40; B65H 75/24

(52) U.S. Cl. ..... 242/388.6; 242/395; 242/578; 242/403.1

(58) Field of Search ..... 242/388.6, 395, 242/395.1, 402, 403.1, 407, 578, 578.2, 594.3, 388, 388.1; 206/702, 393, 419, 420

(56) References Cited

U.S. PATENT DOCUMENTS

| | | | | | |
|---|---|---|---|---|---|
| 741,463 | A | * | 10/1903 | Courville | 242/578.2 |
| 777,956 | A | * | 12/1904 | Kelly | 242/578 |
| 3,072,357 | A | * | 1/1963 | Sprague et al. | 242/578 |
| 4,649,954 | A | * | 3/1987 | Dunwoody | 242/388.6 |
| 4,917,323 | A | * | 4/1990 | Wing | 242/407 |
| 5,265,815 | A | * | 11/1993 | Soyka et al. | 242/388.6 |
| 5,364,042 | A | * | 11/1994 | Wyman | 242/578.2 |
| 5,598,985 | A | | 2/1997 | Winesett | 242/395 |
| 5,661,953 | A | | 9/1997 | Jolley | 53/430 |
| 5,941,388 | A | | 8/1999 | Spielberger | 206/419 |
| 5,957,401 | A | | 9/1999 | O'Donnell | 242/402 |
| 6,009,688 | A | | 1/2000 | Pedersen et al. | 53/399 |
| 6,431,489 | B1 | | 8/2002 | Rose | 242/405.2 |
| 6,467,623 | B1 | * | 10/2002 | Lewis et al. | 206/419 |
| 6,497,381 | B2 | | 12/2002 | Rose | 242/402 |
| 6,557,792 | B1 | * | 5/2003 | Snow | 242/395.1 |
| 6,612,436 | B1 | * | 9/2003 | Zullo | 206/419 |
| 6,676,069 | B1 | * | 1/2004 | Davis | 242/578.2 |
| 2003/0006204 | A1 | * | 1/2003 | Baker | 206/419 |

* cited by examiner

*Primary Examiner*—John M. Jillions
(74) *Attorney, Agent, or Firm*—Kurt M. Rylander

(57) ABSTRACT

A holiday decorations string reel including a vertically disposed hollow column with a top end and a bottom end and having a generally cylindrical configuration and a longitudinal centerline with an outer wall spaced a distance from said centerline, a substantially horizontally disposed top flange and bottom flange encapsulating said column at the top end and the bottom end of said column, a plurality of separator disks concentrically mounted along the length of the outer wall of said column, wherein said disks are vertically adjustable up and down the length of the outer wall of said column, and a reel platform rotatably attached to said bottom flange of said column. A method for hanging holiday decorations strings. A method for storing holiday decorations strings.

17 Claims, 2 Drawing Sheets

Fig. 1
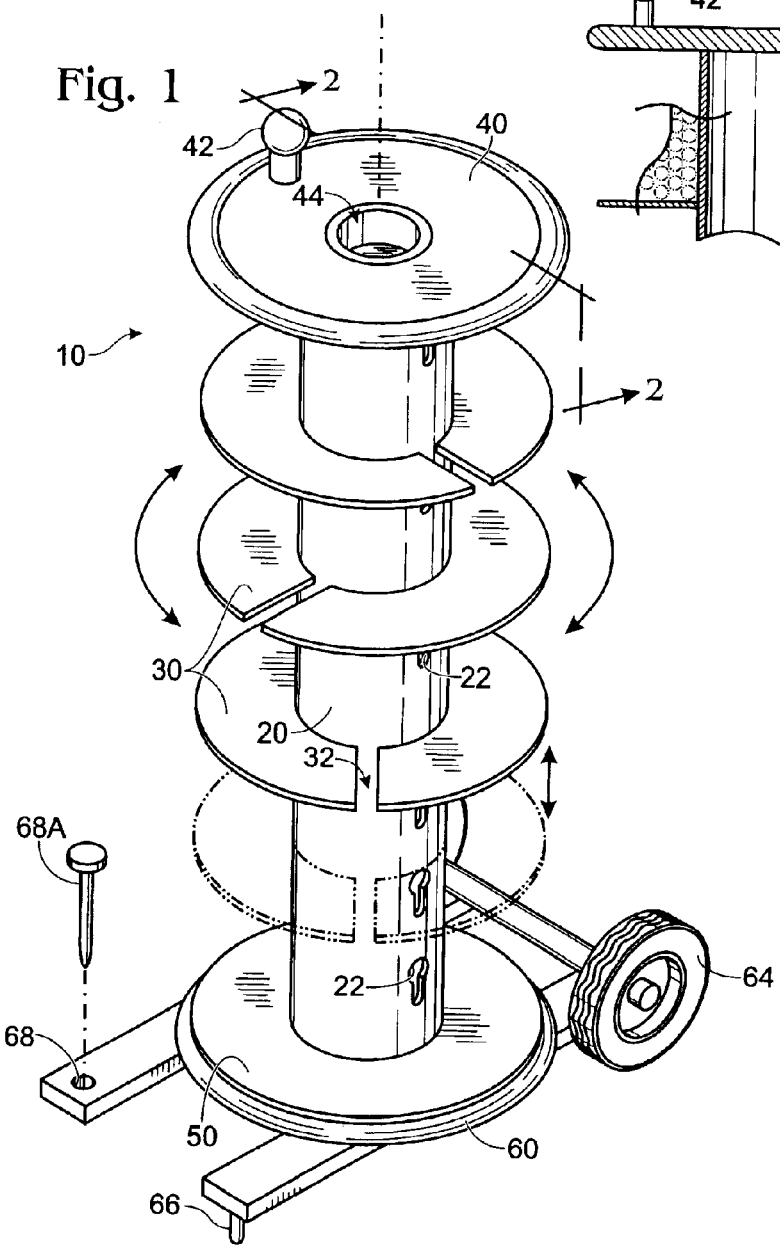
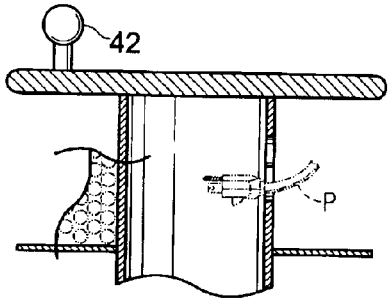
Fig. 2

70
64
66

G
S
42
40
22
22
30
20
50
62
60
64
66

STRING OF LIGHTS REEL

FIELD OF THE INVENTION

The present invention relates to reels for line, cables and wires. More particularly, the present invention relates to reels for strings of lights and ornaments, and wire-wound decorations.

BACKGROUND

Holiday light strings are a well-known adornment for people's homes, gardens, patios, and yards. Hanging Christmas lights has long been a tradition celebrated by many. In addition to lights, a great assortment of which are strung on wires, wires have been strung with other ornaments, such as glass balls, toys, and faux-plants.

The act of hanging holiday light strings is somewhat of an arduous task, especially strings of icicle lights. Icicle light strings have additional parallel light strands that drape from a common wire. The transversely descending lengths of light strands are prone to tangling to one another, as well as to the shared wire. Considering the ease with which tangling occurs, just the thought of hanging strings of icicle lights is stressful. But the thought of attempting to hang them while being precariously perched from a ladder seems downright unsafe.

The act of storing light strings is equally as difficult. Improper storage can cause bulb breakage, damage to the sockets, and ornament destruction. Known light string reels describe using horizontally disposed reels for coiling. However, such a configuration cannot accommodate icicle light strings because of their descending parallel light strands.

Thus, there is a need for a string of lights reel that provides a tangle-free storage configuration and facilitates hanging the different types and sizes of commercially available wire-wound decorations, including icicle lights strings.

A number of devices have provided a reel configuration for storage of light strings, but lack the ability, among other things, to store different types of holiday decoration strings at the same time on the reel, and lack the ability to store such bulky holiday decorations such as icicle light strings. Moreover, presently known descriptions fail to provide a reel that stores more than one type of light string and wire-wound decoration, and fail to describe a reel that facilitates the hanging of light strings while perched from a ladder. The following represents a list of known art:

| Reference: | Issued to: | Date of Issue: |
|---|---|---|
| 6,497,381 | Rose | Dec. 24, 2002 |
| 6,009,688 | Pedersen, et al. | Jan. 4, 2000 |
| 5,957,401 | O'Donnell | Sep. 28, 1999 |
| 5,941,388 | Spielberger | Aug. 24, 1999 |
| 5,661,953 | Jolley | Sep. 2, 1997 |
| 5,598,985 | Winesett | Feb. 4, 1997 |
| 6,431,489 | Rose | Aug. 13, 2002 |

The teachings of each of the above-listed citations (which does not itself incorporate essential material by reference) are herein incorporated by reference. None of the above inventions and patents, taken either singularly or in combination, is seen to describe the instant invention as claimed.

SUMMARY AND ADVANTAGES

The present invention provides a holiday decorations string reel including a vertically disposed hollow column with a top end and a bottom end and having a generally cylindrical configuration and a longitudinal centerline with an outer wall spaced a distance from said centerline, a substantially horizontally disposed top flange and bottom flange encapsulating said column at the top end and the bottom end of said column, a plurality of separator disks concentrically mounted along the length of the outer wall of said column, wherein said disks are vertically adjustable up and down the length of the outer wall of said column, and a reel platform rotatably attached to said bottom flange of said column. The present invention also provides methods for hanging and storing holiday decorations strings.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

FIG. 1 shows a perspective view of an embodiment of the present invention.

FIG. 2 shows a view of the embodiment of FIG. 1.

DETAILED DESCRIPTION

Figures 3, 4:
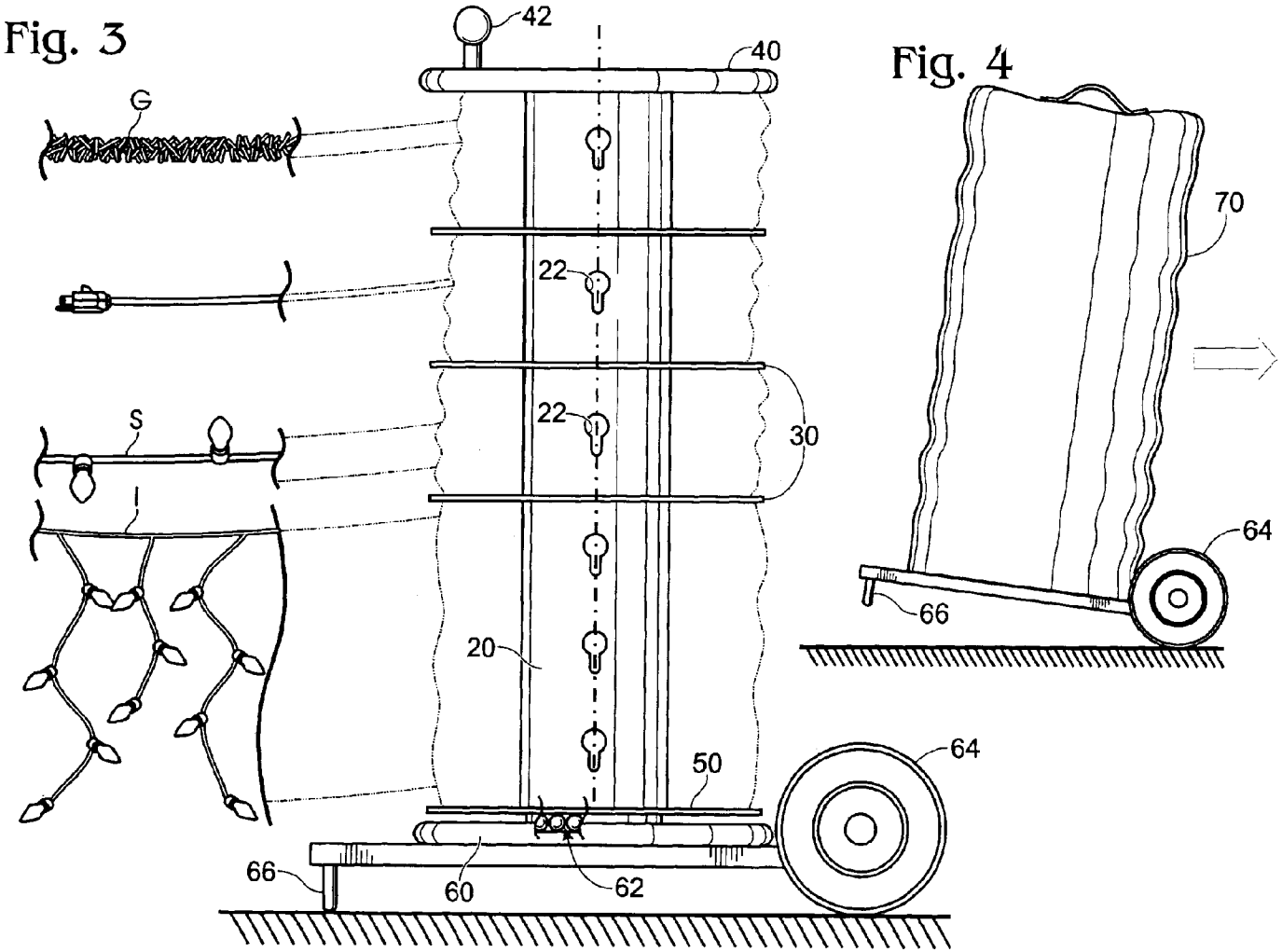
FIG. 3 shows another view of the embodiment of FIG. 1.
FIG. 4 shows a string of lights reel in transit with a cover.

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

As shown in FIGS. 1–4, a string of lights reel 10 is provided comprising a vertically disposed hollow column 20 with a top end and a bottom end having a generally cylindrical configuration and a longitudinal centerline with an outer wall spaced a distance from said centerline, a substantially horizontally disposed top flange 40 and bottom flange 50 encapsulating said column at the top end and the bottom end of said column, a plurality of separator disks 30 concentrically mounted along the length of the outer wall of said column, wherein said disks are vertically adjustable up and down the length of the outer wall of said column, a reel platform 60 rotatably attached to said bottom flange of said column.

The reel 10 comprises a hollow column 20 having concentrically mounted separator disks 30. The separator disks 30 are vertically adjustable for separately storing an assortment of wire-wound decorations on one convenient and portable reel 10 without tangling and knotting. The column 20 is flanked on the top and bottom ends by two flanges 40 and 50, respectively. The column 20 and flanges 40, 50 collectively rotate relative to a reel platform 60 allowing strings of light to be manually wound and unwound on the column 20. As shown in FIG. 4, a storage bag 70 to cover the reel during periods of non-use and storage may also be provided As shown in FIG. 3, the reel 10 holds strings of light S, garland G, icicle light strings I, and other recognized wire based holiday decorations strings.

The hollow column 20 is of vertical disposition having an interior wall, as well as an outer wall. The column 20 is fabricated from a desired material, such as plastic, metal, wood, rubber or combinations thereof. Vertically spaced along the length of the column 20 are apertures 22 for securing ends P of wire-wound decorations S, G, and/or I during winding and unwinding. The hollow column 20 receives the decoration ends P via the apertures 22. The apertures 22 are fashioned and shaped as shown in FIGS. 1–3 to securely hold in place an end P of a string of lights S, garland G, and icicle light string I. With a decoration end P remaining securely in place, the column 20 is rotated in either a clockwise or counterclockwise direction to effectuate the winding or unwinding of the wire-wound decorations S, G, I.

The separator disks 30 are concentrically mounted along the length of the column 20. The disks 30 are ring-shaped, and adjustable up and down the column's 20 length dividing the column 20 into differently spaced partitions for separately reeling up different types of wire-wound decorations S, G, I. As shown in FIG. 3, an icicle light string I with its descending strands of icicle lines requires more winding room to allow the descending light strands to hang in a downward manner than a garland G. The disks 30 are positioned accordingly by sliding up and down the length of the column 20 to permit different types of decorations to be stored separately. Since the space between the disks 30 is adjustable, a wire-wound decoration, such as an icicle light string I that requires more winding space because of its descending parallel light strands, can be wound and unwound on to the column 20 without significant tangling and knotting. At the same time, there is still space partitioned for additional wire-wound decorations, such as garland G and strings of lights S. The disks 30 are constructed of similar material as the column 20 and each disk 30 includes a radially positioned slot 32 which can function as a guide-wind while the column 20 is rotating. The slots 32 feed the light strings S, G, I onto or off of the column 20 by providing a start or finish point for winding or unwinding. Unused disks 30 are stored along the length of the column 20 where they will not interfere with the stored decorations.

The column 20 is encapsulated at the top and bottom ends by a top flange 40 and a bottom flange 50. Both flanges 40 and 50 are greater in diameter than the column 20 and provide a containment of the inner tube formed in the hollowed out column 20. Together, the two flanges 40 and 50 are polar, end separator disks, and the flanges 40 and 50 collectively with the column 20 are the rotating elements of the embodiments of the present invention.

A handle 42 may be provided on the top flange 40. Inside the top end of the column 20, through the top flange 40 a receptacle 44 formed in the hollow top end of the column 20 may be provided. The receptacle 44 is capable of storing extra gutter clips, spare fuses, and bulbs B. A snap on lid Z (not shown) may be provided to cover the receptacle 44.

As shown in FIGS. 1, 3 and 4, the string reel 10 includes a reel platform 60 rotatably attached to the bottom flange 50. The reel platform 60 is the support for the column 20 and the flanges 40, 50. The platform 60 includes ball bearings 62 which provide the rotation of the column 20 and flanges 40, 50 relative to the reel platform 60. The ball bearings 62 are known in the art as a means for providing rotation and can be of any suitable construction as long the function of rotation is achieved. The platform and bottom flange alternatively can be provided with an axle about which the column can turn. Axles are known in the art as a means for providing rotation and can be of any suitable construction as long the function of rotation is achieved. As the reel platform 60 remains stationary, the column 20 and flanges 40, 50 rotate about the reel platform 60 in either a clockwise or counterclockwise direction. The reel platform 60 may include a pair of wheels 64 attached on one end of the platform 60 in a manner similar to known hand trucks. The reel 10 can be positioned and moved to a desired location by operating the reel 10 in a hand truck manner. Furthermore, the reel platform 60 may include a pair of foot pegs 66 oppositely positioned to the wheels 64. The foot pegs 66, when staked into the ground at the desired location, provide a stop-support and secured pivot point for the reel 10. Alternatively, base can have spike holes 68 where foot pegs are located, and spikes 68A can be driven through holes into ground.

In an alternative embodiment the hollow column 20 is stuffed with a packing material 24 to hold and secure ends P of the wire-wound decorations S, G, I as the ends P are received in the apertures 22.

In operation in one embodiment, the string of lights reel 10 having wire-wound decorations S, G, I stored thereon, can be moved via the wheels 64 to a desired location where the light strings are to be hung, such as the exterior of a house. The reel platform 60 is secured into the ground via the foot pegs 66 providing a stationary pivot point in which the column 20 can rotate about. The icicle light string I is unwound from the reel 10. The icicle light string I is fed off the column 20 through the separator disk slot 32 by manually pulling the icicle light string I from the reel 10 which, in turn, causes the column 20 to freely rotate with each pull and unwind the icicle light string I. The icicle light string I is hung incrementally until the secured end of the light string P is ready to be unsecured from the reel 10 and hung in its desired location.

In removing the icicle light string I from the house, the reel 10 is again repositioned to a desired location. After the icicle light string I has been de-clipped from its hanging points, one end P of the icicle light string I is engaged through the aperture 22 and secured for winding. Then the common wire of the icicle light string I is fed into the separator disk slot 32 to guide the wire portion accurately around the column 20 during winding. The handle 42 is utilized to begin reeling in the icicle light string I. As the wire portion winds around the column 20 the descending light strands are vertically disposed down the length of the column 20 free of tangles and knots. Once the icicle light string I is wound up, the storage bag 70 covers the reel 10 and the reel 10 is stored away until further use.

Those skilled in the art will recognize that modifications and changes may be made to the preferred embodiment without departing from the scope of the claimed invention, some modification being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

What is claimed is:

1. A holiday decorations string reel, comprising:

a vertically disposed hollow column with a top end and a bottom end having a generally cylindrical configuration and a longitudinal centerline with an outer wall spaced a distance from said centerline;

a substantially horizontally disposed top flange and bottom flange encapsulating said column at the top end and the bottom end of said column;

a plurality of separator disks concentrically mounted along the length of the outer wall of said column, wherein said disks are vertically adjustable up and down the length of the outer wall of said column; and a reel platform rotatably attached to said bottom flange of said column.

2. The reel of claim 1, further comprising means for facilitating manual rotation of said column relative to said reel platform.

3. The reel of claims 1, wherein said reel platform has at least two wheels used for manual movement.

4. The reel of claims 1, further comprising a receptacle in said top end of column for storing clips, bulbs and fuses.

5. The reel of claims 1, wherein said top and said bottom flange have a substantially greater diameter than the diameter of said column.

6. The reel of claims 1, wherein a handle is mounted to said top flange for facilitating manual rotation of said column relative to said reel platform.

7. The reel of claims 1, wherein said column has a plurality of vertically disposed apertures to receive the ends of wire-wound decorations.

8. The reel of claims 1, wherein said plurality of separator disks have a slot radially extending from the inner circumference of said dividers to the outer circumference for engaging and guiding the wire-wound decorations on to and off of said column.

9. The reel of claim 1, 2, 3, 4, 5, 6, 7 or 8, further comprising at least one holiday decorations string reeled around said column between at least one said flange and at least one said separator disk.

10. A method for storing at least holiday decorations string, comprising:

providing the reel of claim 1, 2, 3, 4, 5, 6, 7 or 8;

positioning said reel platform to a desired location;

securing a first end of the holiday decorations string to said column;

adjusting at least one separator disk for vertical spacing between said disk and at least one said flange;

engaging the holiday decorations string in said slot of said disks; and winding the holiday decorations string around said column between said disk and said flange.

11. The method of claim 10, wherein said winding step is effectuated by rotating the column in the direction of winding.

12. A method for storing at least holiday decorations string, comprising:

providing the reel of claim 1, 2, 3, 4, 5, 6, 7 or 8;

positioning said reel platform to a desired location;

securing a first end of the holiday decorations string to said column;

adjusting at least one separator disk for vertical spacing between said disk and at least one said flange;

engaging the holiday decorations string in said slot of said disks; and winding the holiday decorations string around said column between said disk and said flange.

13. The method of claim 12, wherein said winding step is effectuated by rotating the column in the direction of winding.

14. A method for hanging at least holiday decorations string, comprising:

providing the reel of claim 1, 2, 3, 4, 5, 6, 7 or 8;

positioning said reel platform to a desired location;

unwinding a first end of the holiday decorations string away from said column;

hanging the holiday decorations string in a desired position as the string unwinds from said column;

freeing a second end of the holiday decorations string from said column;

hanging the second end in a desired position.

15. The method of claim 14, wherein said unwinding step is effectuated from and elevated position.

16. A method for hanging at least holiday decorations string, comprising:

providing the reel of claim 1, 2, 3, 4, 5, 6, 7 or 8;

positioning said reel platform to a desired location;

unwinding a first end of the holiday decorations string away from said column;

hanging the holiday decorations string in a desired position as the string unwinds from said column;

freeing a second end of the holiday decorations string from said column;

hanging the second end in a desired position.

17. The method of claim 16 wherein said unwinding step is effectuated from and elevated position.

* * * * *